US007147127B2

(12) United States Patent
Lepke et al.

(10) Patent No.: US 7,147,127 B2
(45) Date of Patent: Dec. 12, 2006

(54) PILL DISPENSER

(75) Inventors: Steve Lepke, Wakefield, MA (US); Robert D. Monahan, Norwell, MA (US); Andrew W. Marsden, Hingham, MA (US)

(73) Assignee: Cosco Management, Inc., Wilmington, DE (US)

( * ) Notice: Subject to any disclaimer, the term of this patent is extended or adjusted under 35 U.S.C. 154(b) by 320 days.

(21) Appl. No.: 10/804,957

(22) Filed: Mar. 19, 2004

(65) Prior Publication Data

US 2005/0205595 A1 Sep. 22, 2005

(51) Int. Cl.
*G07F 11/00* (2006.01)

(52) U.S. Cl. ..... 221/4; 221/83

(58) Field of Classification Search ..... 221/4, 221/82, 83, 92, 90; 206/534, 538, 539, 533; 220/507, 525, 253, 281, 315, 323
See application file for complete search history.

(56) References Cited

U.S. PATENT DOCUMENTS

| | | | | |
|---|---|---|---|---|
| 1,680,131 | A | | 8/1928 | Corl |
| 2,236,224 | A | | 3/1941 | Raschkind |
| 2,903,127 | A | | 9/1959 | Dorman |
| 2,953,242 | A | | 9/1960 | Shaw |
| 3,393,795 | A | | 7/1968 | Covert, Jr. |
| 3,561,592 | A | | 2/1971 | McCool |
| 3,572,282 | A | * | 3/1971 | Tump et al. ..... 116/308 |
| 3,604,559 | A | | 9/1971 | McCall et al. |
| 3,911,856 | A | | 10/1975 | Ewing |
| 3,921,806 | A | | 11/1975 | Wawracz |
| 3,926,335 | A | | 12/1975 | Dangles et al. |
| 3,984,031 | A | | 10/1976 | Thompson |
| 4,069,942 | A | | 1/1978 | Marshall et al. |
| 4,078,661 | A | | 3/1978 | Thomas |
| 4,083,452 | A | | 4/1978 | Rossmo |
| 4,124,143 | A | | 11/1978 | Thomas |
| 4,164,301 | A | | 8/1979 | Thayer |
| 4,261,468 | A | | 4/1981 | Krebs |
| 4,288,006 | A | | 9/1981 | Clover, Jr. |
| 4,555,044 | A | * | 11/1985 | Pearo ..... 221/19 |
| 4,572,376 | A | | 2/1986 | Wrennall |
| 5,322,166 | A | | 6/1994 | Crowther |
| 5,762,199 | A | | 6/1998 | Aguilera |
| 5,782,359 | A | | 7/1998 | McAllister et al. |
| 5,921,395 | A | | 7/1999 | Alexander |
| 6,126,010 | A | | 10/2000 | Kogen |
| 6,325,241 | B1 | | 12/2001 | Garde et al. |
| 6,991,110 | B1 | * | 1/2006 | Flynn et al. ..... 206/725 |

* cited by examiner

*Primary Examiner*—David H. Bollinger
(74) *Attorney, Agent, or Firm*—Barnes & Thornburg LLP

(57) ABSTRACT

A pill dispenser includes a base formed to include several pill-receiving compartments and a cover formed to include an opening. The cover is mounted for rotation on the base to allow a user to align the cover opening with a selected one of the pill-receiving compartments so that the user can access any pills stored in the selected pill-receiving compartment.

43 Claims, 6 Drawing Sheets

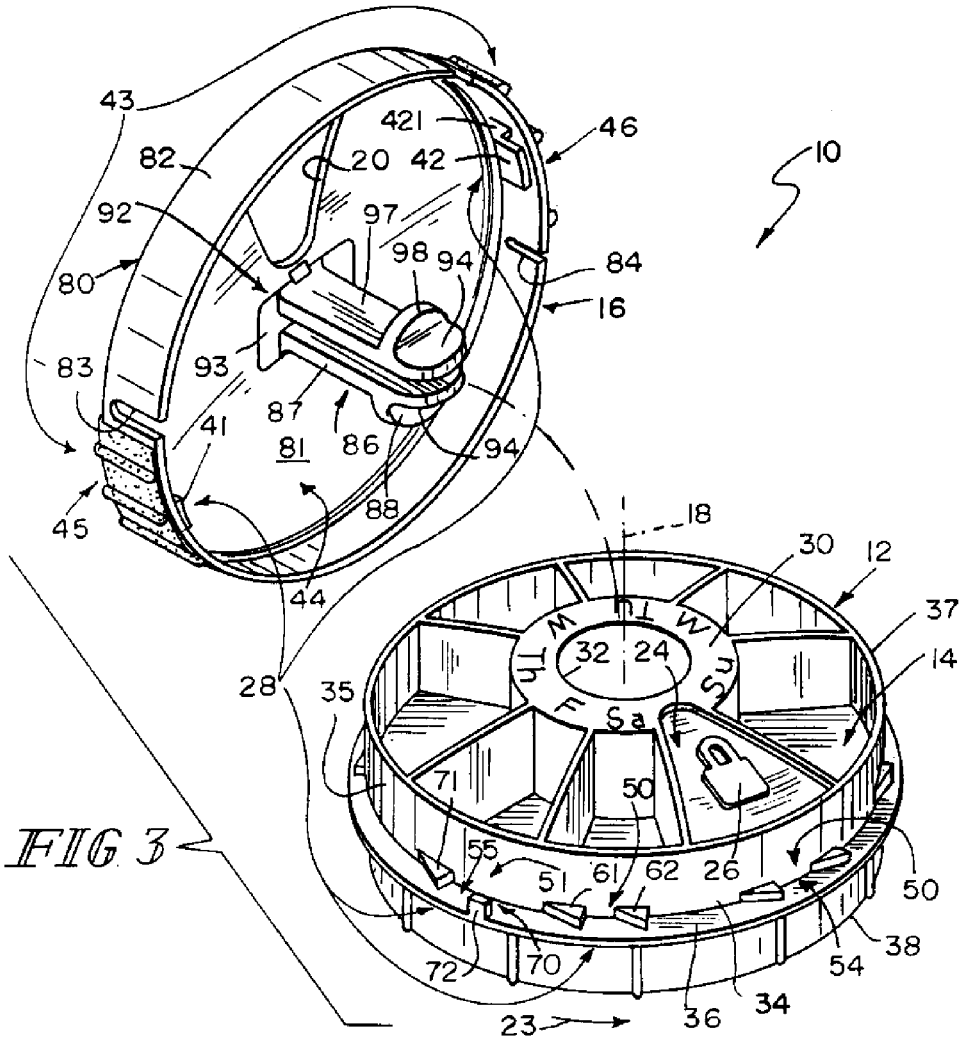
FIG 3
FIG 4
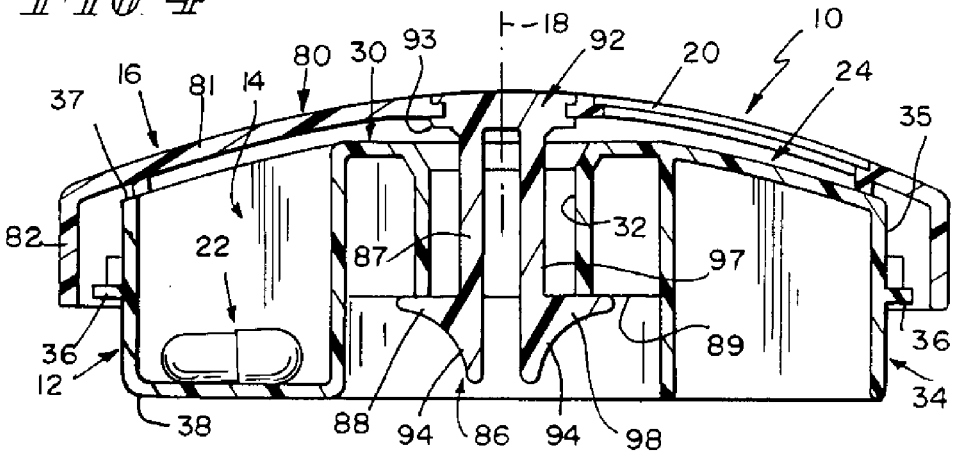

PILL DISPENSER

BACKGROUND

The present disclosure relates to dispensers, and particularly to dispensers for pills or capsules. More particularly, the present disclosure relates to a vitamin and medicine dispenser with a multiple-compartment base and a closure rotatable relative to the base to control access to compartments in the base.

Pill dispensers include compartments for storing pills. A lid is provided to close all of the compartments at the same time or each of the compartments separately.

SUMMARY

A pill dispenser in accordance with the present disclosure includes a base formed to include a series of pill-receiving compartments and a closure mounted for rotation on the base and formed to include a compartment access opening. A user rotates the closure to align the compartment access opening with one of the pill-receiving compartments to access any pills stored in that compartment.

In illustrative embodiments, the base also includes a rotation controller that is interposed between the base and the closure and a lock-out section that is interposed between a first and last in the series of pill-receiving compartments. The rotation controller functions to "lock" the closure so that it cannot normally rotate further relative to the base whenever the closure is rotated to a "closed position" in which the compartment access opening is aligned with the lock-out section included in the base. The rotation controller includes a side button coupled to the closure. To "release" the closure for further rotation relative to the base, the side button is pressed to unlock the closure from the base, thus "freeing" the closure for rotation relative to the base to allow access to pills in the compartments.

During use, it is expected that the closure will normally be placed by a user in the closed position until the user needs to access a pill in one of the compartments. A compartment is provided for each day of the week so there are seven compartments in all.

The user presses a side button coupled to the closure to unlock the closure. The side button moves to disengage a lock tab coupled to the closure from a lock tab receiver coupled to the base. The user then rotates the closure to align the compartment access opening formed in the closure with the pill-receiving compartment for the appropriate day. After removing one or more pills from that compartment, the user can rotate the closure to the closed position.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 3 is a perspective assembly view similar to FIG. 2 showing a pair of cantilevered cover retainers extending from the underside of a cover included in the rotatable closure and a lock tab associated with each of the lock-release side buttons of the rotatable cover;

FIG. 4 is a sectional view taken along line 4—4 of FIG. 1 showing extension of the cantilevered cover retainers through a central retainer aperture formed in the multi-compartment base to mount the cover for rotation relative to the base and showing engagement of retainer flanges included in the cover retainers with a retention flange provided on a bottom portion of the base at a lower inlet opening into the central retainer aperture;

DETAILED DESCRIPTION

Figure 1:
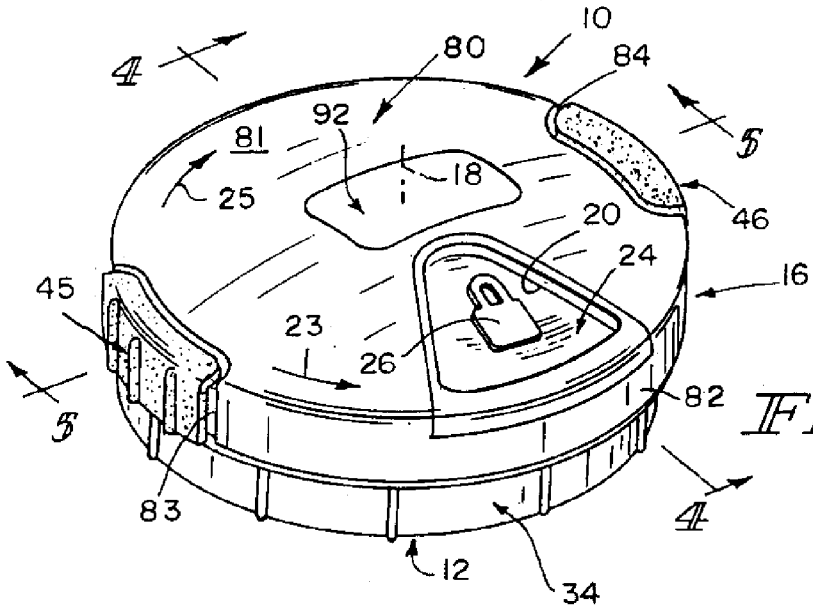
FIG. 1 is a perspective view of a pill dispenser according to the present disclosure showing a rotatable closure retained in a locked position relative to a base to limit access to pills stored in the base.
Figure 2:
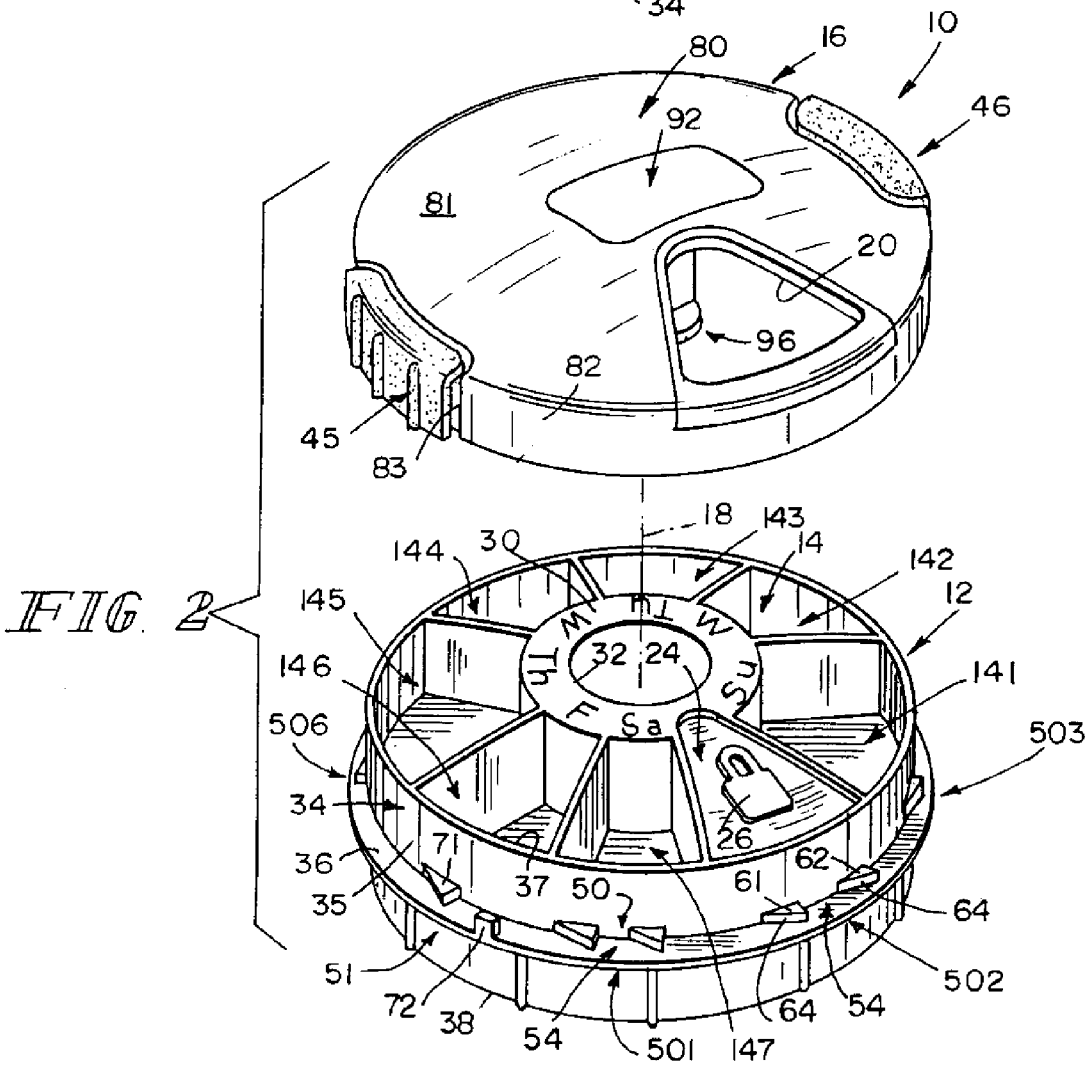
FIG. 2 is a perspective assembly view of components included in the pill dispenser of FIG. 1 showing seven pill-receiving compartments formed in the base, a "pie-shaped" compartment access opening formed in the rotatable closure, and two spaced-apart lock-release side buttons coupled to the rotatable closure to lie in diametrically opposed relation to one another.

A pill dispenser 10 includes a base 12 formed to include pill-receiving compartments 14 and a closure 16 mounted on base 12 for rotation about an axis of rotation 18 as suggested in FIGS. 1 and 2. Closure 16 is formed to include a compartment access opening 20.

Figure 6:
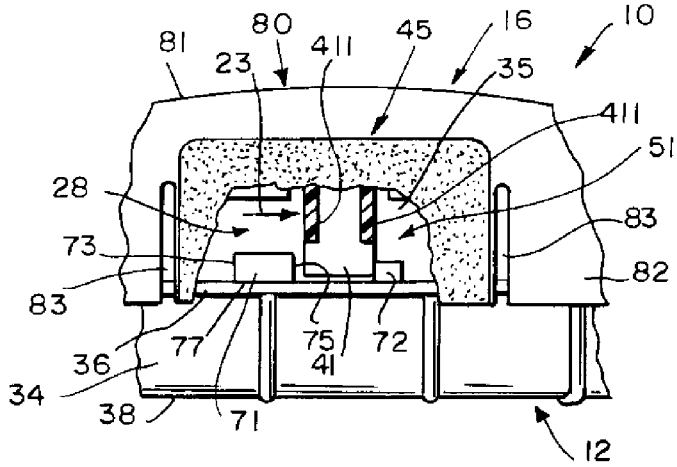
FIG. 6 is a sectional view taken along line 6—6 of FIG. 5 with a portion of a side button broken away to show a lock tab in a "lock-out" pocket formed between a ramp tooth and a lock-out tooth included in a motion-blocking limiter.
Figure 9:
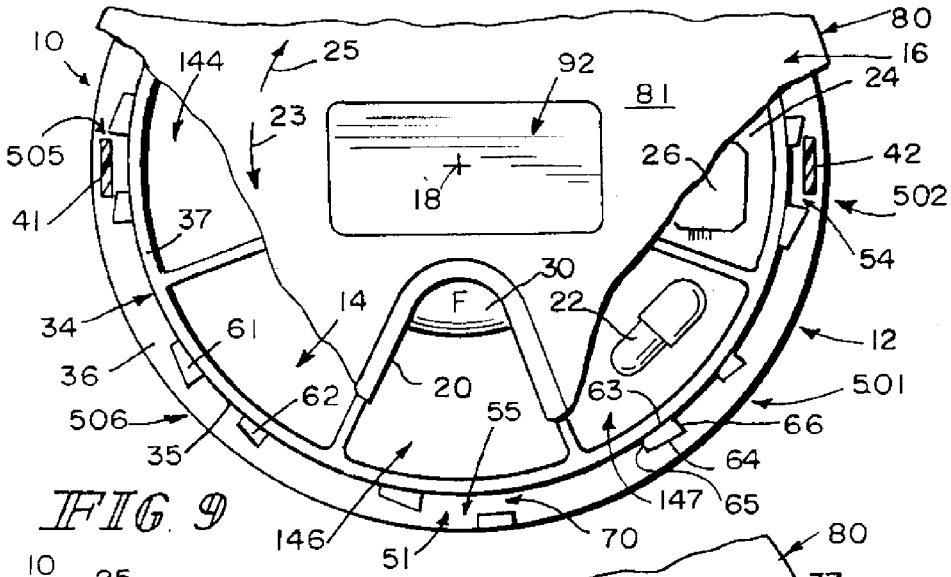
FIG. 9 is a top plan view of the pill dispenser of FIG. 1 after the cover has been rotated relative to the base to permit a user to gain access to the "Friday" compartment in the base through the pie-shaped compartment access opening formed in the cover and aligned with the Friday compartment.
Figure 10:
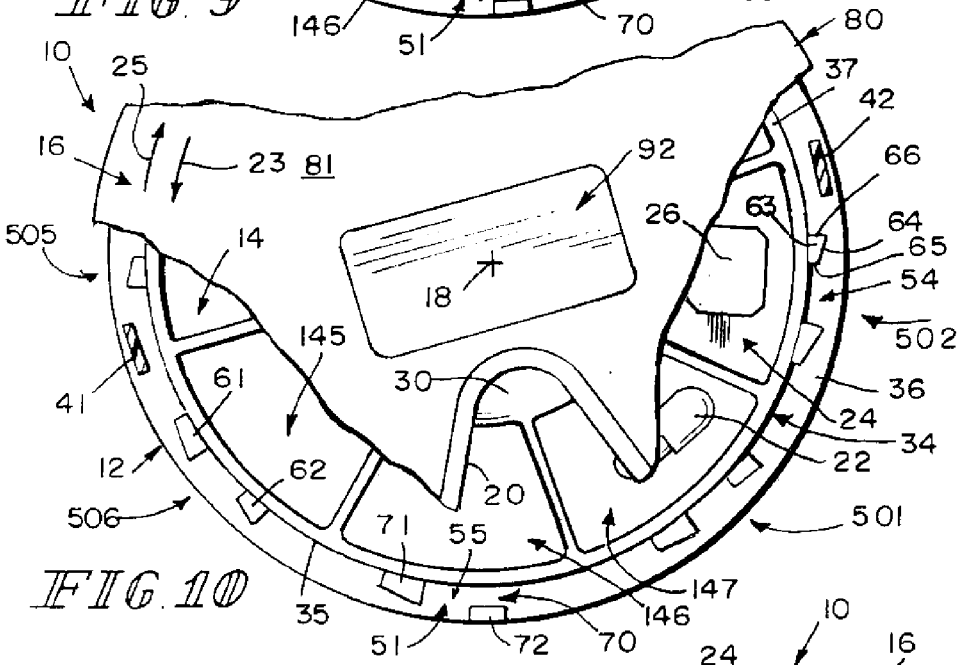
FIG. 10 is a view similar to FIG. 9 showing counterclockwise rotation of the rotatable cover relative to the underlying base.
Figure 11:
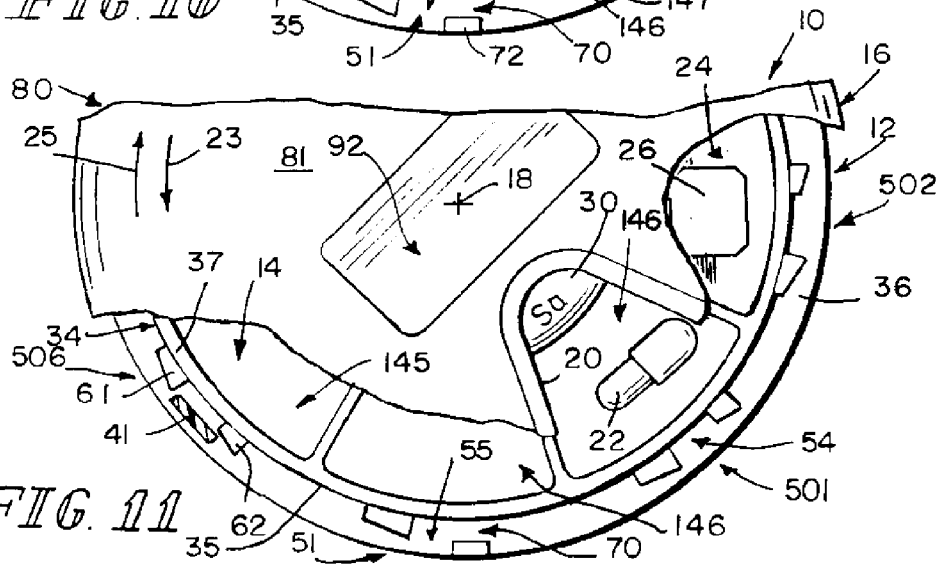
FIG. 11 is a view similar to FIGS. 9 and 10 showing further counterclockwise rotation of the rotatable cover relative to the base to place the pie-shaped compartment access opening formed in the cover in alignment with a "Saturday" compartment located between the Friday compartment and the lock-out section.
Figure 12:
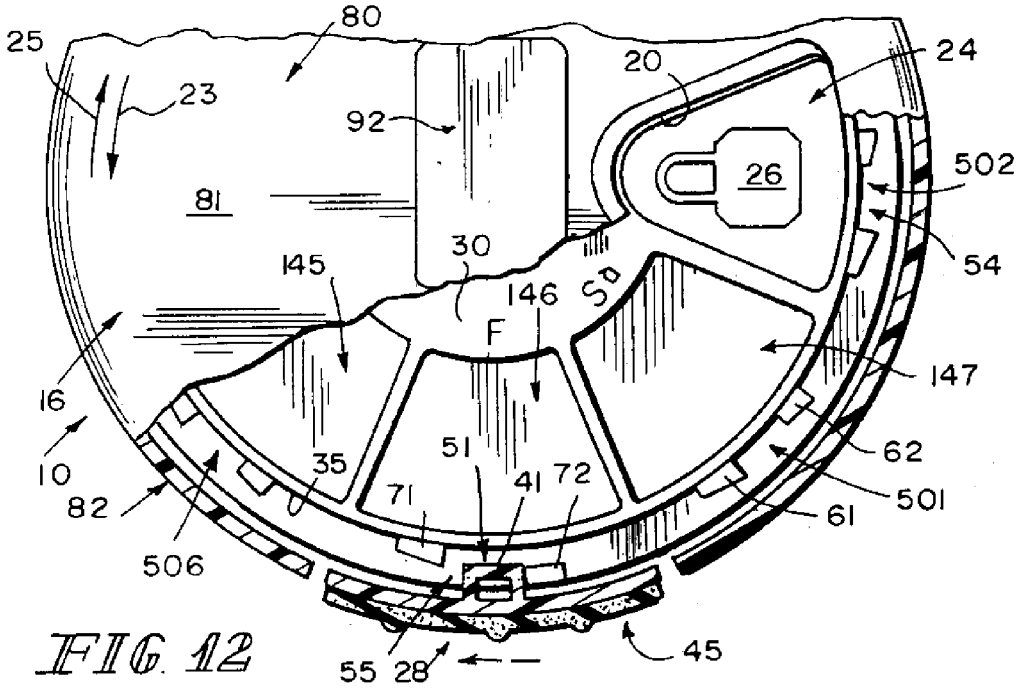
FIG. 12 is a view similar to FIGS. 9–11 showing further counterclockwise rotation of the rotatable cover relative to the base to place the pie-shaped access aperture formed in the cover in alignment with the lock-out section.
Figure 13:
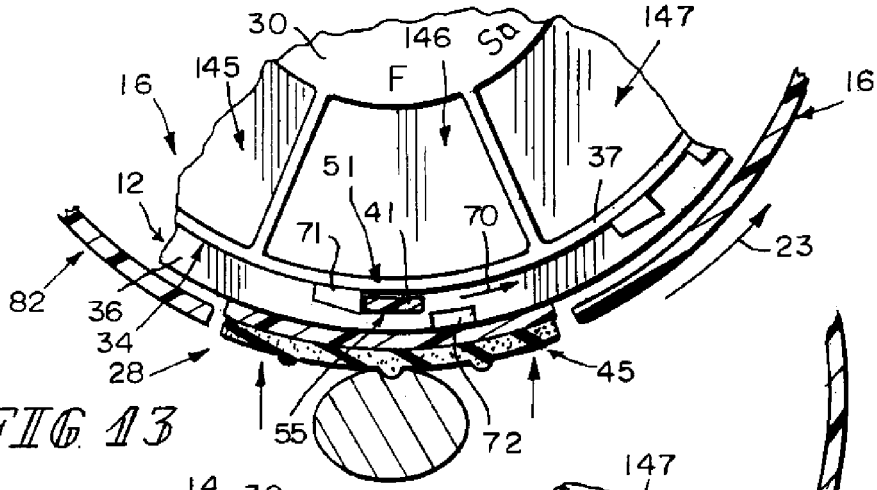
FIG. 13 is a view similar to FIGS. 9–12 showing radially inward movement of one of the lock-release side buttons toward the axis of rotation of the closure to disengage the associated lock tab from a lock-out tooth appended to the base to move the lock tab in the lock-out pocket toward the axis of rotation to face and be aligned with an opening into a lock tab passage defined by the base and the lock-out tooth so that the lock tab is free to pass into and through the lock tab passage (in the direction of the arrow) to exit the lock-out pocket in response to rotation of the closure in the counterclockwise direction so as to allow further counterclockwise rotation of the cover relative to the base.
Figure 14:
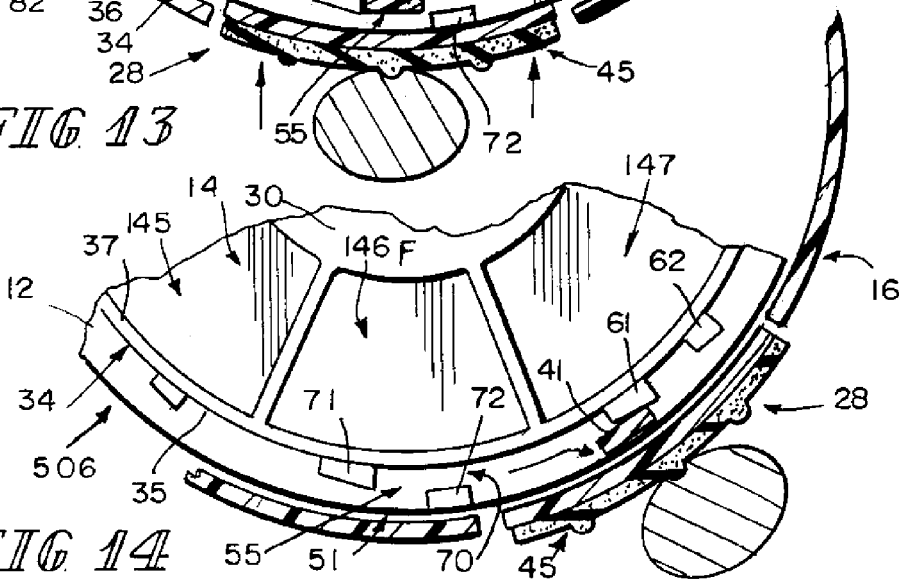
FIG. 14 is a view similar to FIGS. 9–13 showing radially outward movement of the lock tab of FIG. 13 as it cams on one of the inclined teeth appended to the base and before the lock tab "snaps" into the compartment-selector pocket provided between two adjacent inclined teeth cooperating to define a motion-blocking limiter to retain the closure in one of the preset rotary positions relative to the base.

A user rotates closure 16 about axis 18 to align compartment access opening 20 with one of pill-receiving compartments 14 to access any pills 22 stored in that compartment as suggested in FIGS. 9–11. A user can rotate closure 16 about axis 18 in a first rotary direction 23 to align compartment access opening 20 with a lock-out section 24 (carrying a lock-out symbol 26) as suggested in FIG. 1 to cause a rotation controller 28 (interposed between base 12 and closure 16 as suggested in FIG. 3) to "lock" closure 16 so that it is not able to rotate further relative to base 12 as shown in FIGS. 6 and 12. When desired, a user can operate rotation controller 28, for example, in the manner suggested in FIG. 13 to unlock closure 16 so that it can be rotated further about axis 18 in first rotary direction 23. In the illustrated embodiment, rotation controller 28 is configured to limit rotation of closure 16 about axis of rotation 18 in second rotary direction 25.

Figure 8:
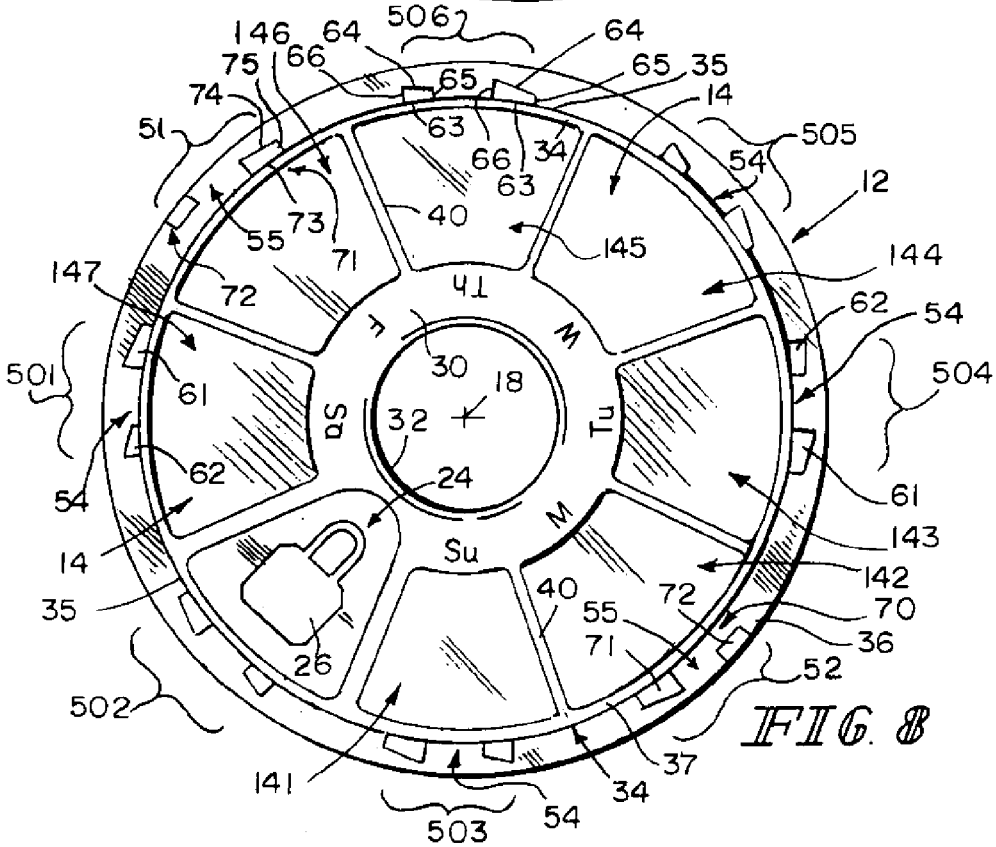
FIG. 8 is a top plan view of the multi-compartment base of FIGS. 1–5 showing a "lock-out" section and a series of seven pill-receiving compartments and showing "motion-interrupting limiter" teeth adjacent to the lock-out section and five of the pill-receiving compartments and "motion-blocking limiter" teeth adjacent to two of the pill-receiving compartments.

As shown in FIGS. 2 and 8, base 12 includes an inner ring 30 formed to include a central retainer aperture 32 and an annular wall 34 arranged to lie in concentric relation to inner ring 30. Seven pill-receiving compartments 14 and lock-out section 24 are located in an annular space provided between inner ring 30 and annular wall 34. An annular flange 36 extends radially outwardly from annular wall 34 away from pill-receiving compartments 14 and lock-out section 24 and lies about midway between a top edge 37 of annular wall 34 and a bottom edge 38 of annular wall 34.

As shown in FIG. 8, base 12 includes a series of radially extending walls 40. These walls 40 are located in circumferentially spaced-apart relation to one another and extend from inner ring 30 to annular wall 34. These walls 40 cooperate with lock-out section 24, inner ring 30, and annular wall 34 to define (in sequence) a first (Sunday) pill-receiving compartment 141, a second (Monday) pill-receiving compartment 142, a third (Tuesday) pill-receiving compartment 143, a fourth (Wednesday) pill-receiving compartment 144, a fifth (Thursday) pill-receiving compartment 145, a sixth (Friday) pill-receiving compartment 146, and a seventh (Saturday) pill-receiving compartment 147. Although lock-out section 24 is interposed between the first and seventh pill-receiving compartments 141, 147, it is within the scope of this disclosure to interpose lock-out section 24 between any pair of adjacent pill-receiving compartments formed in base 12.

In the illustrated embodiment, rotation controller 28 includes a series of teeth appended to base 12 and arranged to engage one or more lock tabs 41, 42 provided in an interior region 44 of closure 16 as suggested in FIGS. 3 and 8. Rotation controller 28 also includes a pair of tab movers (or side buttons) 45, 46 as suggested in FIGS. 3 and 7. Each tab mover 45, 46 is coupled to closure 16 and arranged to be moved by a user to engage and disengage its companion lock tab 41 or 42 from the teeth appended to base 12 to control rotation of closure 16 relative to base 12 as suggested, for example, in FIGS. 9–14.

Figure 7:
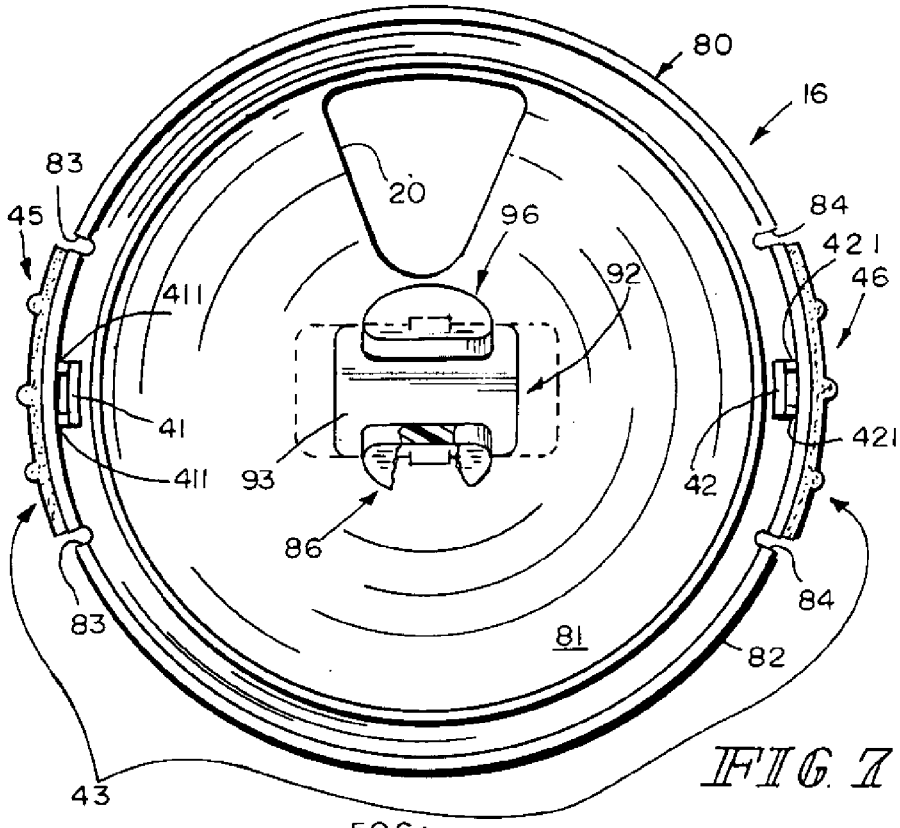
FIG. 7 is a plan view of the underside of the rotatable closure of FIGS. 1–5 showing the two side buttons and the lock tab associated with each side button.

Lock tabs 41, 42 and tab movers 45, 46 cooperate to define a closure lock 43 included in rotation controller 28 as suggested in FIGS. 3 and 7. Thus, each lock tab 41 and 42 is a portion of closure lock 43. Closure lock 43 is coupled to closure 16 to rotate therewith about axis of rotation 18 relative to base 12. Closure lock 43 further includes a first pair of stand-offs 411 lying in spaced-apart relation to one another and interconnecting lock tab 41 and tab mover 45 as shown, for example, in FIGS. 3, 5, 6, and 7 to position lock tab 41 so that it can extend into lock-out pocket 55 and be moved through tab passage space 70. As shown best in FIG. 6, stand-offs 411 are shorter than lock tab 41. Closure lock 43 also includes a second pair of stand-offs 421 lying in spaced-apart relation to one another and interconnecting (auxiliary) lock tab 42 and (auxiliary) tab mover 45 as shown, for example, in FIGS. 3, 5, and 7 to position lock tab 42 so that it can extend into lock-out pocket 55 and be moved through tab passage space 70. Stand-offs 421 are shorter than lock tab 42.

In the illustrated embodiment, two lock tabs 41, 42 and two tab movers 45, 46 are coupled to closure 16. It is within the scope of this disclosure to employ only one lock tab and a companion tab mover. In this disclosure, when two lock tabs and two tab movers are used, one of the lock tabs (e.g., 42) can be referred to as an "auxiliary" lock tab to distinguish it from lock tab 41 and one of tab movers (e.g., 46) can be referred to as an "auxiliary" tab mover. Thus, any motion-interrupting limiter mating temporarily with auxiliary lock tab 42 would be an auxiliary motion-blocking limiter.

Some of the teeth (e.g., teeth 61, 62) on base 12 are paired as shown in FIG. 8 to form "motion-interrupting" limiters 50 which interact with lock tabs 41, 42 on closure 16 to "interrupt" rotation of closure 16 about axis of rotation 18 in first rotary direction 23. Such interruptions provide a "ratcheting" effect as closure 16 is rotated in first rotary direction 23 about base 12 so that compartment access opening 20 formed in closure 16 is aligned in a step-by-step manner and in sequence with each of pill-receiving compartments 141, 142, 143, 144, 145, 146, and 147. The downwardly extending flexible lock tabs 41, 42 move radially outwardly along inclined surfaces provided on the teeth establishing the motion-interrupting limiters 50 and "snap" into pockets 54 provided therein to produce this ratcheting effect. In the illustrated embodiment, six motion-interrupting limiters 501, 502, 503, 504, 505, and 506 are provided.

The series of motion-interrupting limiters 50 includes, as suggested in FIG. 8, a first motion-interrupting limiter 501 adjacent to the seventh pill-receiving compartment 147, a second motion-interrupting limiter 502 adjacent to the lock-out section 24, and a third motion-interrupting limiter 503 adjacent to the first pill-receiving compartment 141. A fourth motion-interrupting limiter 504 is adjacent to the third pill-receiving compartment 143, a fifth motion-interrupting limiter 505 is adjacent to the fourth pill-receiving compartment 144, and a sixth motion-interrupting limiter 506 is adjacent to the fifth pill-receiving compartment 143.

Each motion-interrupting limiter 50 (e.g., 501–506) is formed to include a compartment-selector pocket 54 sized to receive a lock tab 41 or 42 therein. In the case of two lock tabs 41 and 42, as shown, for example, in FIG. 9, lock tab 41 will fit into compartment-selector pocket 54 of one of the motion-interrupting limiters 505 and "auxiliary" lock tab 42 will fit simultaneously into compartment-selector pocket 54 of motion-interrupting limiter 502.

Lock tab 41, during rotation of closure 16 about axis of rotation 18 in first rotary direction 23, is arranged to intercept, in turn, each of the motion-interrupting limiters "associated with" a pill-receiving compartment and extend into compartment-selector pocket 54 formed therein so as to align compartment access opening 20 formed in closure 16 with the pill-receiving compartment formed in base 12 that is associated with the motion-interrupting limiter receiving lock tab 41. For example, as shown best in FIG. 8, and with reference to lock tab 41, first motion-interrupting limiter 501 is associated with first pill-receiving compartment 141, second motion-interrupting limiter 502 is associated with second pill-receiving compartment 142, third motion-interrupting limiter 503 is associated with third pill-receiving compartment 143, fourth motion-interrupting limiter 504 is associated with fifth pill-receiving compartment 145, fifth motion-interrupting limiter 505 is associated with sixth pill-receiving compartment 506, and sixth motion-interrupting limiter 506 is associated with seventh pill-receiving compartment 147.

Likewise, (auxiliary) lock tab 42, during rotation of closure 16 about axis of rotation in first rotary direction 23, is arranged to intercept, in turn, each of the motion-interrupting limiters associated with a pill-receiving compartment and extend into compartment-selector pocket 54 formed therein so as to align compartment access opening 20 formed in closure 16 with the pill-receiving compartment formed in base 12 that is associated with the motion-interrupting limiter receiving (auxiliary) lock tab 42. For example, as shown best in FIG. 8 and with reference to (auxiliary) lock tab 42, fourth motion-interrupting limiter 504 is associated with first pill-receiving compartment 141, fifth motion-interrupting limiter 505 is associated with second pill-receiving compartment 142, sixth motion-interrupting limiter 506 is associated with third pill-receiving compartment 143, first motion-interrupting limiter 501 is associated with fifth pill-receiving compartment 145, second motion-interrupting limiter 502 is associated with sixth pill-receiving compartment 146, and third motion-interrupting limiter 503 is associated with seventh pill-receiving compartment 147.

Others of the teeth (e.g., teeth 71, 72) on base 12 are paired as shown in FIG. 8 to form "motion-blocking" limiters (lock tab retainers) 51 and 52 which interact with lock tabs 41, 42 on closure 16 to "block" further rotation of closure 16 about axis of rotation 18 in first rotary direction 23 to provide a "locking" effect whenever closure 16 is rotated about base 12 so that compartment access opening 20 formed in closure 16 is aligned with lock-out section 24 as shown in FIGS. 1, 5, 6, and 12. In the illustrated embodiment, two motion-blocking limiters 51, 52 are provided. A first motion-blocking limiter 51 (comprising teeth 71, 72) is located adjacent to sixth pill-receiving compartment 146 and a second motion-blocking limiter 52 (comprising teeth 71, 72) is located adjacent to second pill-receiving compartment 142 as shown best in FIG. 8.

Each motion-blocking limiter 51, 52 is formed to include a lock-out pocket 55 sized to receive a lock tab 41 or 42 therein. In the case of two lock tabs 41 and 42, as suggested, for example, in FIG. 12, lock tab 41 will fit into lock-out pocket 55 of motion-blocking limiter 51 and "auxiliary" lock tab 42 simultaneously will fit into lock-out pocket 55 of motion-blocking limiter 52.

Lock tab 41, during rotation of closure 16 about axis or rotation 18 in first rotary direction 23, is arranged to intercept motion-blocking limiter 51 "associated with" lock-out section 24 and extend into lock-out pocket 55 formed therein so as to align compartment access opening 20 formed in closure 16 with lock-out section 24 formed in base 12 to block access into the pill-receiving compartments through compartment access opening 20 formed in closure 16. As it turns out when lock tab 41 fits into lock-out pocket 55 provided in motion-blocking limiter 52, compartment access opening 20 is aligned with fourth pill-receiving compartment 144. It is necessary only to use tab mover 45 to "unlock" closure 16 so that it can be rotated further in first rotary direction 23 to align compartment access opening 20 with fifth pill-receiving compartment 145.

Likewise, (auxiliary) lock tab 42, during rotation of closure 16 about axis of rotation 18 in first direction 23, is arranged to intercept motion-blocking limiter 52 "associated with" lock-out section 24 and extend into lock-out pocket 55 formed therein so as to align compartment access opening 20 formed in closure with lock-out section 24 formed in base 12 to block access into the pill-receiving compartments through compartment access opening 20 formed in closure 16. As it turns out, when lock tab 42 fits into lock-out pocket 55 provided in motion-blocking limiter 51, compartment access opening 20 is aligned with fourth pill-receiving compartment 144. It is necessary only to use tab mover 46 to "unlock" closure 16 so that it can be rotated further in first rotary direction 23 to align compartment access opening 20 with fifth pill-receiving compartment 145.

Each of motion-interrupting limiters 50 (e.g., 501–506) includes first and second inclined teeth 61, 62 arranged to lie in spaced-apart relation to one another to define compartment-selector pocket 54 between first and second inclined teeth 61, 62. First and second inclined teeth 61, 62 are appended to flange 36 and to annular wall 34 to lie at a junction therebetween as suggested in FIGS. 2 and 8. It is within the scope of this disclosure to vary the location of teeth 61, 62 relative to each of flange 36 and wall 34.

Each of inclined teeth 61 and 62 includes a curved inner wall 63 appended to an exterior surface 35 of annular wall 34 and an inclined (sloped) outer wall 64 arranged to face away from exterior surface 35 and extend upwardly from flange 36. Each of inclined teeth 61, 62 includes a short end 65 having a first length and a long end 66 having a second length greater than the first length. Inner wall 63 is arranged to extend between short and long ends 165, 166 and appended to exterior surface 35 of annular wall 34 and inclined outer wall 64 is arranged to extend between short and long ends 65, 66 in spaced-apart relation to inner wall 63. Inclined outer wall 64 cooperates with short end 65 to define an obtuse included angle therebetween and with long end 66 to define an acute included angle therebetween. A bottom wall (not shown) is appended to flange 36 and arranged to lie between inner wall 63, inclined outer wall 64, short end 65, and long end 66. In the illustrated embodiment, teeth 61, 62 are formed monolithically with base 12.

First inclined tooth 61 includes an outer wall 64 sized to have a first length and arranged to face away from exterior surface 35 and engage lock tab 41 (or 42) in camming relation during rotation of closure 16 relative to base 12 about axis of rotation 18 in first rotary direction 23. Second inclined tooth 62 includes an outer wall 64 sized to have a second length that is less than first length and arranged to face away from exterior surface 35 and engage lock tab 41 (or 42) in camming relation during rotation of closure 16 relative to base 12 about axis of rotation 18 in first rotary direction 23.

Inclined outer wall 64 of first inclined tooth 61 is arranged to have a first slope. Inclined outer wall 64 of second inclined tooth 62 is arranged to have a second slope different from and greater than the first slope. The slopes can be measured using a reference line that is tangent to the circular exterior surface 35 of annular wall 34 at a point where a reference line that is collinear with inclined outer wall 64 would intersect exterior surface 35.

Long end wall 66 of each first and second inclined teeth 61, 62 is arranged to extend radially away from exterior surface 35 of base 12 to provide anti-rotation means for intercepting lock tab 41 (or 42) during rotation of closure 16 relative to base 12 about axis of rotation 18 in a second rotary direction 25 opposite to first rotary direction 23 to block continued rotation of closure 16 relative to base 12 in second rotary direction 25. A portion 66 of the anti-rotation means is located on first inclined tooth 61 and arranged to form a portion of a boundary wall defining compartment-selector pocket 54 between first and second inclined teeth 61, 62. A portion 66 of the anti-rotation means is also located on second inclined tooth 62 and arranged to face toward first inclined tooth 61.

Each motion-blocking limiter 51 and 52 includes a ramp tooth 71 and a lock-out tooth 72 arranged to lie in spaced-apart relation to one another to define lock-out pocket 55 therebetween. Base 12 includes an annular wall 34 surrounding lock-out section 24 and pill-receiving compartments 14 (e.g., 141–147) and a flange 36 extending radially outwardly from annular wall 34 away from pill-receiving compartments 14 and lock-out section 24. Each ramp tooth 71 is appended to flange 36 and to annular wall 34 to lie at a junction therebetween. Each lock-out tooth 72 is appended to flange 36 and arranged to define a portion of a boundary wall defining lock-out pocket 55 and to lie in spaced-apart relation to exterior surface 35 of annular wall 36 to provide a tab passage space 70 therebetween sized to allow movement of lock tab 41 (or 42) from lock-out pocket 55. In the illustrated embodiment, teeth 71, 72 are formed monolithically with base 12.

Each ramp tooth 71 includes a curved inner wall 73 appended to an exterior surface 35 of annular wall 34 and an inclined (sloped) outer wall 74 arranged to face away from exterior surface 35 and extend upwardly from flange 36. Each ramp tooth 71 includes a short end 75 having a first length, a long end 76 having a second length greater than the first length. Inner wall 73 is arranged to extend between short and long ends 75, 76 and inclined outer wall 74 is arranged to extend between short and long ends 75, 76 in spaced-apart relation to inner wall 73. Inclined outer wall 74 cooperates with short end 75 to define an obtuse included angle therebetween and with long end 76 to define an acute included angle therebetween. Bottom wall 77 is appended to flange 36 (as shown in FIG. 6) and arranged to lie between inner wall 73, inclined outer wall 74, short end 75, and long end 76.

Inclined outer wall 74 of each ramp tooth 71 is sloped to provide means for moving lock tab 41 or 42 away from exterior surface 35 of annular wall 34 as the lock tab is rotated in first rotary direction 23 toward lock-out tooth 72 and about axis of rotation 18 and then depositing lock tab 41 of 42 in lock-out pocket 55. End wall 74 of each ramp tooth 71 is arranged to extend radially away from exterior surface 35 of base 12 to provide anti-rotation means for intercepting the lock tab 41, 42 during rotation of closure 16 relative to base 12 about axis of rotation 18 in a second rotary direction 25 opposite to first rotary direction 23 to block continued rotation of closure 16 relative to base 12 in second rotary direction 25. Lock-out tooth 72 provides anti-rotation means for intercepting lock tab 41, 42 normally during continued rotation of the lock tab 41, 42 in first rotary direction 23 to block continued rotation of closure 16 relative to base 12 in first rotary direction.

As suggested in FIGS. 3, 5, 7, and 13, rotation controller 28 further includes release means on closure 16 for moving lock tabs 41, 42 to disengage lock-out teeth 72 when lock tabs 41, 42 are located in lock-out pockets 55 formed in motion-blocking limiters 51, 52 so that lock tabs 41 or 42 are free to pass through tab passage spaces 70 formed in base 12 and located adjacent to lock-out tooth 72 to exit lock-out pocket 55 in response to rotation of closure 16 in first rotary direction 23 about axis of rotation 18 and away from ramp tooth 71.

As suggested in FIGS. 3 and 7, closure 16 includes a cover 80 formed to include compartment access opening 20. Cover 80 includes a top wall 81 and an annular rim 82 depending from a perimeter of top wall 81. Rim 82 is formed to include a pair of diametrically opposed cutaway gaps 83, 84. Lock tab 41 extends downwardly from the perimeter of top wall 81 and lies in registry with cutaway gap 83. Lock tab 42 extends in a similar manner to lie in registry with cutaway gap 84.

The releasing means includes a tab mover (side button) 45 located in cutaway gap 83 and coupled to top wall 81 and to lock tab 41 to place lock tab 41 between axis of rotation 18 and tab mover 45. Tab mover 45 is hinged to top wall 81 to be moved relative to rim 28 and toward axis of rotation 18 to move lock tab 41 to disengage lock-out tooth 72 and align with tab passage space 70 as shown, for example in FIG. 13.

The releasing means also includes an (auxiliary) tab mover (side button) 46 located in (auxiliary) cutaway gap 84 and coupled to top wall 81 and to (auxiliary) lock tab 42 to place (auxiliary) lock tab 42 between axis of rotation 18 and (auxiliary) tab mover 46 as shown, for example, in FIG. 7. (Auxiliary) tab mover 46 is hinged to move lock tab 42 to disengage lock-out tooth 72 and align with tab passage space 70.

Cover 80 is arranged to overlie pill-receiving compartments 14 (e.g., 141–147) and lock-out section 24. Closure 16 also includes a first cover retainer 86 including a first retainer leg 87 and a first retainer flange 88. First retainer leg 87 is cantilevered to an underside of top wall 81 and arranged to extend downwardly and generally along axis of rotation 18 through central retainer aperture 32 formed in base 12 and surrounded by pill-receiving compartments 14 and lock-out section 24. First retainer flange 88 is appended to a free end of first retainer leg 87 and arranged to extend laterally away from first retainer leg 87 to engage a retention flange 89 provided on a bottom portion of base 12 as shown, for example, in FIGS. 4 and 5.

Closure 16 further includes a second cover retainer 96 arranged to cooperate with first cover retainer 86 to "establish" axis of rotation 18 extending through central retainer aperture 32 and to mount cover 80 on base 12 for rotation about axis of rotation 18. Second cover retainer 96 includes a second retainer leg 97 and a second retainer flange 98. First retainer leg 97 is cantilevered to an underside of top wall 81 and arranged to extend downwardly in splayed relation to first retainer leg 87 and generally along axis of rotation 18 through central retainer aperture 32. Second retainer flange 98 is appended to a free end of second retainer leg 97 and arranged to extend laterally away from second retainer leg 97 to engage retention flange 89 provided on a bottom portion of base 12 as suggested in FIG. 4.

Figure 5:
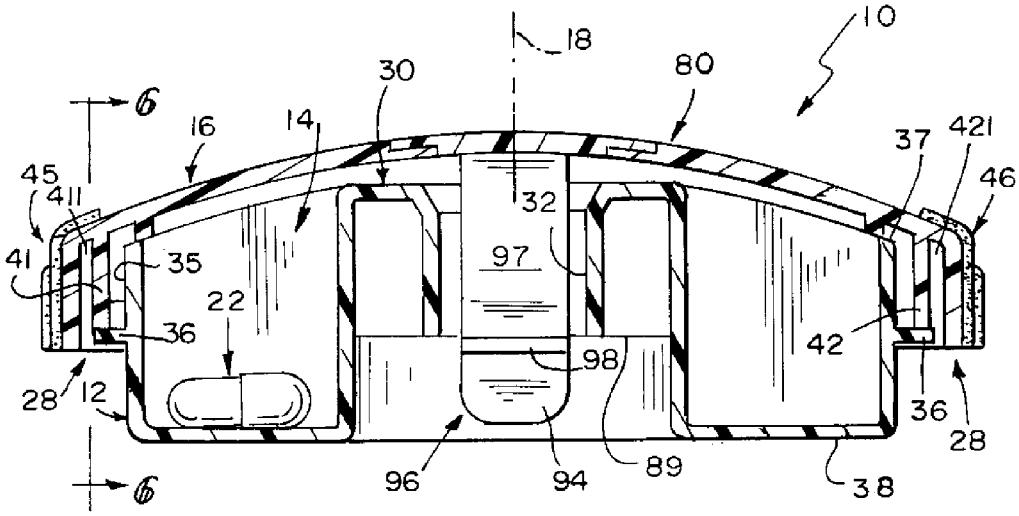
FIG. 5 is a sectional view taken along line 5—5 of FIG. 1 showing a lock tab and a side button (or tab mover) on the "left" side of the cover and an auxiliary lock tab and auxiliary side button (or tab mover) on the "right" side of the cover.

Retainer legs 87, 88 are made of a spring material and arranged normally to lie in splayed relation to one another to diverge as retainer legs 87, 97 extend in a downward direction away from top wall 81 of cover 80. Each retainer leg 87, 97 further includes a grip portion 94 at a distal end thereof that is arranged to lie outside of central retainer aperture 32 formed in base 12 when cover 80 is mounted for rotation on base 12. Grip portions 94 cooperate to form means for disengaging retainer flanges 88, 98 from retention flange 89 on base 12 upon movement of retention legs 87, 97 toward one another so that cover 80 can be separated from base 92 upon removal of the pair of cover retainers 86, 96 from the central retainer aperture 32 formed in base 12. As shown in FIGS. 3–5, proximal ends of each of retainer legs 87, 97 are appended to a leg mount 92 that is coupled to cover 80 to anchor cover retainers 86, 96 in an initial position relative to cover 80. As suggested in FIGS. 3 and 4 an inwardly facing wall 93 of leg mount 92 forms a continuation of the underside of top wall 81.

The invention claimed is:

1. A pill dispenser comprising a base formed to includc a series of pill-receiving compartments and a lock-out section interposed between a first and last in the series of pill-receiving compartments, a closure formed to include a compartment access opening and mounted on the base for rotation relative to the base about an axis of rotation to align the compartment access opening formed in the closure with one of the lock-out section to block access to pills deposited in any of the pill-receiving compartments and a selected one of the pill-receiving compartments to allow access to a pill deposited in the selected one of the pill-receiving compartments, and a rotation controller including a closure lock coupled to the closure to rotate therewith, a series of motion-interrupting limiters appended to the base, and a motion-blocking limiter appended to the base, each motion-interrupting limiter being associated with one of the pill-receiving compartments and formed to include a compartment-selector pocket sized to receive a lock tab portion of the closure lock therein, the motion-blocking limiter being associated with the lock-out section and formed to include a lock-out pocket sized to receive the lock tab portion of the closure lock therein, and wherein the lock tab portion of the closure lock, during rotation of the closure about the axis of rotation in a first rotary direction, is arranged to intercept each motion-interrupting limiter associated with a pill-receiving compartment and extend into the compartment-selector pocket formed therein to align the compartment access opening formed in the closure with the pill-receiving compartment formed in the base and associated with the motion-interrupting limiter receiving the lock tab portion of the closure lock and is also arranged to intercept the motion-blocking limiter associated with the lock-out section and extend into the lock-out pocket formed therein to align the compartment access opening formed in the closure with the lock-out section formed in the base to block access into the pill-receiving compartments through the compartment access opening formed in the closure.

2. The pill dispenser of claim 1, wherein a first of the motion-interrupting limiters includes first and second inclined teeth arranged to lie in spaced-apart relation to one another to define therebetween the compartment-selector pocket formed in the first of the motion-interrupting limiters.

3. The pill dispenser of claim 2, wherein the base includes an annular wall surrounding the lock-out section and the pill-receiving compartments and a flange extending radially outwardly from the annular wall away from the pill-receiving compartments and the lock-out section and the first and second inclined teeth are appended to the flange and to the annular wall to lie at a junction therebetween.

4. The pill dispenser of claim 3, wherein each of the inclined teeth includes a curved inner wall appended to an exterior surface of the annular wall and an inclined outer wall arranged to face away from the exterior surface and extend upwardly from the flange.

5. The pill dispenser of claim 3, wherein each of the inclined teeth includes a short end having a first length, a long end having a second length greater than the first length, an inner wall arranged to extend between the short and long ends and appended to an exterior surface of the annular wall, an inclined outer wall arranged to extend between the short and long ends in spaced-apart relation to the inner wall and to cooperate with the short end to define an obtuse included angle therebetween and with the long end to define an acute included angle therebetween, and a bottom wall appended to the flange and arranged to lie between the inner wall, inclined outer wall, short end, and long end.

6. The pill dispenser of claim 3, wherein each of the inclined teeth includes an inner wall appended to an exterior surface of the annular wall, the first inclined tooth includes an outer wall sized to have a first length and arranged to face away from the exterior surface and engage the lock tab portion of the closure lock in camming relation during rotation of the closure relative to the base about the axis of rotation in the first rotary direction, and the second inclined tooth includes an outer wall sized to have a second length that is less than the first length and arranged to face away from the exterior surface and engage the lock tab portion of the closure lock in camming relation during rotation of the closure relative to the base about the axis of rotation in the first rotary direction.

7. The pill dispenser of claim 2, wherein the first inclined tooth includes an inclined outer wall arranged to have a first slope and to engage the lock tab portion of the closure lock in camming relation during rotation of the closure relative to the base about the axis of rotation in the first rotary direction and the second inclined tooth includes an inclined outer wall arranged to have a second slope different from the first slope and to engage the lock tab portion of the closure lock during further rotation of the closure relative to the base about the axis of rotation in the first rotary direction.

8. The pill dispenser of claim 7, wherein the second slope is greater than the first slope.

9. The pill dispenser of claim 7, wherein at least one of the first and second inclined teeth includes an end wall arranged to extend radially away from the base to provide anti-rotation means for intercepting the lock tab portion of the closure lock during rotation of the closure relative to the base about the axis of rotation in a second rotary direction opposite to the first rotary direction to block continued rotation of the closure relative to the base in the second rotary direction.

10. The pill dispenser of claim 2, wherein at least one of the first and second inclined teeth includes an end wall arranged to extend radially away from the base to provide anti-rotation means for intercepting the lock tab portion of the closure lock during rotation of the closure relative to the base about the axis of rotation in a second rotary direction opposite to the first rotary direction to block continued rotation of the closure relative to the base in the second rotary direction.

11. The pill dispenser of claim 10, wherein each of the first and second inclined teeth includes the anti-rotation means.

12. The pill dispenser of claim 10, wherein the anti-rotation means is located on the first inclined tooth and arranged to form a portion of a boundary wall defining the compartment-selector pocket between the first and second inclined teeth.

13. The pill dispenser of claim 10, wherein a second of the motion-interrupting limiters includes a first inclined tooth arranged to lie in spaced-apart relation to the first inclined tooth of the first of the motion-interrupting limiters to locate the second inclined tooth therebetween and wherein the anti-rotation means is located on the second inclined tooth and arranged to face toward the first inclined tooth of the second of the motion-interrupting limiters.

14. The pill dispenser of claim 1, wherein the series of pill-receiving compartments includes, in series, first, second, third, fourth, fifth, sixth, and seventh pill-receiving compartments, the series of motion-interrupting limiters includes a first motion-interrupting limiter adjacent to the seventh pill-receiving compartment, a second motion-interrupting limiter adjacent to the lock-out section, a third motion-interrupting limiter adjacent to the first pill-receiving compartment, a fourth motion-interrupting limiter adjacent to the third pill-receiving compartment, a fifth motion-interrupting limiter adjacent to the fourth pill-receiving compartment, and a sixth motion-interrupting limiter adjacent to the fifth pill-receiving compartment.

15. The pill dispenser of claim 14, wherein the motion-blocking limiter is adjacent to the second pill-receiving compartment.

16. The pill dispenser of claim 14, wherein the motion-blocking limiter is adjacent to the sixth pill-receiving compartment.

17. The pill dispenser of claim 16, wherein the closure lock further includes an auxiliary lock tab portion located on the closure in spaced-apart relation to the lock tab portion, the rotation controller further includes an auxiliary motion-blocking limiter associated with the lock-out section and formed to include an auxiliary lock-out pocket sized to receive the auxiliary lock tab portion of the closure lock therein, the auxiliary motion-blocking limiter is arranged to lie adjacent to the second pill-receiving compartment, the auxiliary lock tab portion of the closure lock, during rotation of the closure about the axis of rotation in the first rotary direction, is arranged to intercept the auxiliary motion-blocking limiter associated with the lock-out section and extend into the auxiliary lock-out pocket formed therein to align the compartment access opening formed in the closure with the lock-out section formed in the base to block access into the pill-receiving compartments through the compartment access opening formed in the closure.

18. The pill dispenser of claim 1, wherein the motion-blocking limiter includes a ramp tooth and a lock-out tooth arranged to lie in spaced-apart relation to one another to define therebetween the lock-out pocket formed in the motion-blocking limiter.

19. The pill dispenser of claim 18, wherein the base includes an annular wall surrounding the lock-out section and the pill-receiving compartments and a flange extending radially outwardly from the annular wall away from the pill-receiving compartments and the lock-out section, the ramp tooth is appended to the flange and to the annular wall to lie at a junction therebetween, and the lock-out tooth is appended to the flange and arranged to define a portion of a boundary wall defining the lock-out pocket and to lie in spaced-apart relation to the annular wall to provide a tab passage space therebetween sized to allow movement of the lock tab portion of the closure lock to pass therethrough during exit of the lock tab portion from the lock-out pocket.

20. The pill dispenser of claim 19, wherein the ramp tooth includes a curved inner wall appended to an exterior surface of the annular wall and an inclined outer wall arranged to face away from the exterior surface and extend upwardly from the flange.

21. The pill dispenser of claim 19, wherein the ramp tooth includes a short end having a first length, a long end having a second length greater than the first length, an inner wall arranged to extend between the short and long ends and appended to an exterior surface of the annular wall, an inclined outer wall arranged to extend between the short and long ends in spaced-apart relation to the inner wall and to cooperate with the short end to define an obtuse included angle therebetween and with the long end to define an acute included angle therebetween, and a bottom wall appended to the flange and arranged to lie between the inner wall, inclined outer wall, short end, and long end.

22. The pill dispenser of claim 19, wherein the ramp tooth includes an inclined outer wall sloped to provide means for moving the lock tab portion of the closure lock away from the annular wall as the lock tab portion is rotated in the first rotary direction toward the lock-out tooth and about the axis of rotation and then depositing the lock tab portion in the lock-out pocket and the lock-out tooth provides anti-rotation means for intercepting the lock tab portion of the closure lock normally during continued rotation of the lock tab portion in the first rotary direction to block continued rotation of the closure relative to the base in the first rotary direction.

23. The pill dispenser of claim 22, wherein the ramp tooth further includes an end wall arranged to extend radially away from the base to provide anti-rotation means for intercepting the lock tab portion of the closure lock during rotation of the closure relative to the base about the axis of rotation in a second rotary direction opposite to the first rotary direction to block continued rotation of the closure relative to the base in the second rotary direction.

24. The pill dispenser of claim 18, wherein the ramp tooth includes an end wall arranged to extend radially away from the base to provide anti-rotation means for intercepting the lock tab portion of the closure lock during rotation of the closure relative to the base about the axis of rotation in a second rotary direction opposite to the first rotary direction to block continued rotation of the closure relative to the base in the second rotary direction.

25. The pill dispenser of claim 18, wherein the closure lock further includes release means on the cover for moving the lock tab portion to disengage the lock-out tooth when the lock tab portion is located in the lock-out pocket formed in the motion-blocking limiter so that the lock tab portion is free to pass through a tab passage space formed in the base and located adjacent to the lock-out tooth to exit the lock-out pocket in response to rotation of the cover in a first rotary direction about the axis of rotation and away from the ramp tooth.

26. The pill dispenser of claim 25, wherein the cover includes a top wall and a rim depending from a perimeter of the top wall, the rim is formed to include a cutaway gap, the lock tab portion extends downwardly from the perimeter of the top wall and lies in registry with the cutaway gap, the releasing means includes a tab mover located in the cutaway gap and coupled to the top wall and to the lock tab portion to place the lock tab portion between the axis of rotation and the tab mover, and wherein the tab mover is hinged to the top wall to be moved relative to the rim and toward the axis of rotation to move the lock tab portion to disengage the lock-out tooth and align with the tab passage space.

27. The pill dispenser of claim 1, wherein the closure lock further includes release means on the cover for moving the lock tab portion in the lock-out pocket toward the axis of rotation to face and be aligned with an opening into a lock tab passage formed in the motion-blocking limiter so that the lock tab portion is free to pass into and through the lock tab passage to exit the lock-out pocket in response to rotation of the cover about the axis of rotation in the first rotary direction.

28. The pill dispenser of claim 27, wherein the cover includes a top wall and a rim depending from a perimeter of the top wall, the rim is formed to include a cutaway gap, the lock tab portion extends downwardly from the perimeter of the top wall and lies in registry with the cutaway gap, the releasing means includes a tab mover located in the cutaway gap and coupled to the top wall and to the lock tab portion to place the lock tab portion between the axis of rotation and the tab mover, and wherein the tab mover is hinged to the top wall to be moved relative to the rim and toward the axis of rotation to move the lock tab portion to align with the tab passage space.

29. The pill dispenser of claim 1, wherein the closure includes a cover arranged to overlie the pill-receiving compartments and the lock-out section and formed to include the compartment access opening and a first cover retainer including a first retainer leg and a first retainer flange, the first retainer leg is cantilevered to an underside of the cover and arranged to extend downwardly and generally along the axis of rotation through a central retainer aperture formed in the base and surrounded by the pill-receiving compartments and the lock-out section, and the first retainer flange is appended to a free end of the retainer leg and arranged to extend laterally away from the retainer leg to engage a retention flange provided on a bottom portion of the base.

30. The pill dispenser of claim 29, wherein the closure further includes a second cover retainer arranged to cooperate with the first cover retainer to establish the axis of rotation extending through the central retainer aperture and to mount the cover on the base for rotation about the axis of rotation and wherein the second cover retainer includes a second retainer leg and a second retainer flange, the first retainer leg is cantilevered to an underside of the cover and arranged to extend downwardly in splayed relation to the first retainer leg and generally along the axis of rotation through the central retainer aperture, and the second retainer flange is appended to a free end of the second retainer leg and arranged to extend laterally away from the second retainer leg to engage the retention flange provided on the bottom portion of the base.

31. A pill dispenser comprising a base formed to include a series of pill-receiving compartments and a lock-out section interposed between a first and last in the series of pill-receiving compartments, a closure formed to include a compartment access opening and mounted on the base for rotation relative to the base about an axis of rotation to align the compartment access opening formed in the closure with one of the lock-out section to block access to pills deposited in any of the pill-receiving compartments and a selected one of the pill-receiving compartments to allow access to a pill deposited in the selected one of the pill-receiving compartments, and a rotation controller including a lock tab coupled to the closure to rotate therewith and a lock tab retainer associated with the lockout section, and wherein the lock tab retainer is appended to the base and configured to receive the lock tab in a lock-out pocket provided by the lock tab retainer during rotation of the closure about the axis of rotation in a first rotary direction upon alignment of the compartment access opening formed in the closure with the lock-out section to block further rotation of the closure in the first rotary direction and to block access into the pill-receiving compartments through the compartment access opening formed in the closure.

32. The pill dispenser of claim 31, wherein the series of pill-receiving compartments includes, in series, first, second, third, fourth, fifth, sixth, and seventh pill-receiving compartments and the lock tab retainer is adjacent to one of the second and sixth pill-receiving compartments.

33. The pill dispenser of claim 31, wherein the closure lock further includes an auxiliary lock tab portion located on the closure in spaced-apart relation to the lock tab portion, the rotation controller further includes an auxiliary lock tab retainer associated with the lock-out section, the auxiliary lock tab retainer is appended to the base to lie in spaced-apart relation to the lock tab retainer and configured to receive one of the lock tab and auxiliary lock tab in an auxiliary lock-out pocket provided by the auxiliary lock tab retainer during rotation of the closure about the axis of rotation in the first rotary direction, the auxiliary lock tab retainer is arranged to lie adjacent to the second pill-receiving compartment to intercept the auxiliary motion-blocking limiter associated with the lock-out section and extend into the auxiliary lock-out pocket formed therein upon alignment of the compartment access opening formed in the closure with the lock-out section formed in the base to block further rotation of the closure in the first rotary direction and to block access into the pill-receiving compartments through the compartment access opening formed in the closure.

34. The pill dispenser of claim 33, wherein the series of pill-receiving compartments includes, in series, first, second, third, fourth, fifth, sixth, and seventh pill-receiving compartments, the lock tab retainer is adjacent to the sixth pill-receiving compartment, and the auxiliary lock tab retainer is adjacent to the second pill-receiving compartment.

35. The pill dispenser of claim 34, wherein the rotation controller further includes release means on the cover for moving the lock tab in the lock-out pocket toward the axis of rotation to face and be aligned with an opening into a lock tab passage defined by the base and the lock tab receiver so that the lock tab is free to pass into and through the lock tab passage to exit the lock-out pocket in response to rotation of the cover about the axis of rotation in the first rotary direction and for moving the auxiliary lock tab in the auxiliary lock-out pocket toward the axis of rotation to face and be aligned with an opening into an auxiliary lock tab passage defined by the base and the auxiliary lock tab receiver, so that the auxiliary lock tab is free to pass into and through the auxiliary lock tab passage to exit the auxiliary lock-out pocket in response to rotation of the cover about the axis of rotation in the first rotary direction.

36. The pill dispenser of claim 31, wherein the lock tab retainer includes a ramp tooth and a lock-out tooth arranged to lie in spaced-apart relation to one another to define therebetween the lock-out pocket provided by the lock tab retainer.

37. The pill dispenser of claim 36, wherein the base includes an annular wall surrounding the lock-out section and the pill-receiving compartments and a flange extending radially outwardly from the annular wall away from the pill-receiving compartments and the lock-out section, the ramp tooth is appended to the flange and to the annular wall to lie at a junction therebetween, and the lock-out tooth is appended to the flange and arranged to define a portion of a boundary wall defining the lock-out pocket and to lie in spaced-apart relation to the annular wall to provide a tab passage space therebetween sized to allow movement of the lock tab of the closure lock to pass therethrough during exit of the lock tab from the lock-out pocket.

38. The pill dispenser of claim 37, wherein the ramp tooth includes an inclined outer wall sloped to provide means for moving the lock tab away from the annular wall as the lock tab is rotated in the first rotary direction toward the lock-out tooth and about the axis of rotation and then depositing the lock tab in the lock-out pocket and the lock-out tooth provides anti-rotation means for intercepting the lock tab normally during continued rotation of the lock tab in the first rotary direction to block continued rotation of the closure relative to the base in the first rotary direction.

39. The pill dispenser of claim 36, wherein the ramp tooth includes an end wall arranged to extend radially away from the base to provide anti-rotation means for intercepting the lock tab during rotation of the closure relative to the base about the axis of rotation in a second rotary direction opposite to the first rotary direction to block continued rotation of the closure relative to the base in the second rotary direction.

40. The pill dispenser of claim 36, wherein the rotation controller further includes release means on the cover for moving the lock tab to disengage the lock-out tooth when the lock tab is located in the lock-out pocket so that the lock tab is free to pass through a tab passage space formed in the base and located adjacent to the lock-out tooth to exit the lock-out pocket in response to rotation of the cover in a first rotary direction about the axis of rotation and away from the ramp tooth.

41. The pill dispenser of claim 40, wherein the cover includes a top wall and a rim depending from a perimeter of the top wall, the rim is formed to include a cutaway gap, the lock tab extends downwardly from the perimeter of the top wall and lies in registry with the cutaway gap, the releasing means includes a tab mover located in the cutaway gap and coupled to the top wall and to the lock tab to place the lock tab between the axis of rotation and the tab mover, and wherein the tab mover is hinged to the top wall to be moved relative to the rim and toward the axis of rotation to move the lock tab to disengage the lock-out tooth and align with the tab passage space.

42. The pill dispenser of claim 31, wherein the closure lock further includes release means on the cover for moving the lock tab in the lock-out pocket toward the axis of rotation to face and be aligned with an opening into a lock tab passage defined by the base and the lock tab retainer so that the lock tab portion is free to pass into and through the lock tab passage to exit the lock-out pocket in response to rotation of the cover about the axis of rotation in the first rotary direction.

43. The pill dispenser of claim 42, wherein the cover includes a top wall and a rim depending from a perimeter of the top wall, the rim is formed to include a cutaway gap, the lock tab extends downwardly from the perimeter of the top wall and lies in registry with the cutaway gap, the releasing means includes a tab mover located in the cutaway gap and coupled to the top wall and to the lock tab to place the lock tab between the axis of rotation and the tab mover, and wherein the tab mover is hinged to the top wall to be moved relative to the rim and toward the axis of rotation to move the lock tab portion to align with the tab passage space.

* * * * *